US006189620B1

(12) United States Patent
McDowell

(10) Patent No.: US 6,189,620 B1
(45) Date of Patent: Feb. 20, 2001

(54) METHOD AND APPARATUS FOR SHUTTING OFF UPWARD FLOW FROM A CONDUIT

(76) Inventor: Bobby Dewain McDowell, P.O. Box 1554, Montgomery, TX (US) 77356

( * ) Notice: Under 35 U.S.C. 154(b), the term of this patent shall be extended for 0 days.

(21) Appl. No.: 09/629,311

(22) Filed: Jul. 31, 2000

(51) Int. Cl.[7] ..... E21B 33/06

(52) U.S. Cl. ..... 166/379; 166/78.1; 166/79.1; 166/85.4; 166/97.1; 169/69

(58) Field of Search ..... 166/379, 85.4, 166/95.1, 97.1, 78.1, 79.1; 169/69

(56) References Cited

U.S. PATENT DOCUMENTS

| | | | | |
|---|---|---|---|---|
| 1,894,912 | | 1/1933 | Otis . | |
| 2,840,166 | * | 6/1958 | Eckel et al. | 166/55 |
| 2,897,895 | * | 8/1959 | Ortloff | 166/75.14 |
| 3,316,963 | * | 5/1967 | Boldrick et al. | 166/277 |
| 3,905,424 | * | 9/1975 | Elwood et al. | 169/46 |
| 4,359,089 | * | 11/1982 | Strate et al. | 166/79.1 |
| 4,423,774 | | 1/1984 | Mefford | 166/77.5 |
| 4,442,892 | | 4/1984 | Delesandri | 166/85 |
| 4,461,354 | * | 7/1984 | Buras et al. | 166/343 |
| 4,846,271 | | 7/1989 | Dekesabdri | 166/78 |
| 5,092,399 | | 3/1992 | Lang | 166/77.5 |
| 5,121,793 | * | 6/1992 | Busch et al. | 166/79.1 |
| 5,121,797 | * | 6/1992 | DeCuir, Sr. | 166/386 |
| 5,213,157 | * | 5/1993 | Wills | 166/79.1 |
| 5,806,589 | | 9/1998 | Lang | 166/77.53 |

* cited by examiner

*Primary Examiner*—Hoang Dang
(74) *Attorney, Agent, or Firm*—Mary J. Gaskin

(57) ABSTRACT

An apparatus for handling safety valves used for shutting off high pressure upward flow through drill pipe or tubing. The apparatus includes an adjustable clamp assembly for holding the safety valve; a three-stage double-acting hydraulic extension system to provide horizontal (and optionally, rotational) movement of the safety valve; a stable track assembly for vertical movement of the apparatus; and a positioning arm with a yoke for placement against the drill pipe or tubing, providing a distance measurement used to vertically align the safety valve with the drill pipe or tubing.

8 Claims, 9 Drawing Sheets

METHOD AND APPARATUS FOR SHUTTING OFF UPWARD FLOW FROM A CONDUIT

FIELD OF THE INVENTION

The present invention relates to apparatus for handling safety valves used for shutting off high pressure upward flow through drill pipe or tubing.

BACKGROUND OF THE INVENTION

When an oil well is being drilled, drilling personnel may encounter an unexpected high pressure situation requiring them to install a safety valve into the top of the drill pipe or tubing, from which uncontrolled high pressure fluids and gases are flowing.

Various methods are presently used to attempt such installation. The methods share a common feature of positioning the safety valve over the drill pipe while the valve is suspended by a cable, chain or rope catline. Typically, drilling personnel are required to physically align the end of the safety valve (which can weigh from 50 to 300 pounds) with the top of the drill pipe (which may be 5 to 8 feet off the working floor), while fluids and gases are escaping. If flowing pressures do not exceed 50 psi, the present methods can be successful. However, higher pressures can result in serious injury to personnel, either by movement of the suspended safety valve or impact from blown fragments of sand and gravel. If a safety valve cannot be installed, the only recourse is to allow the blowout to continue until the pressurized fluids are exhausted, or until the formation collapses, with detrimental environmental repercussions.

The present invention is directed to overcoming the problems associated with installing a suspended safety valve.

SUMMARY OF THE INVENTION

The present invention utilizes a three-stage double-acting hydraulic extension system to hold and stab a safety valve into the top of a drill pipe or tubing during a high pressure situation. The hydraulic unit is mounted on wheels, which move on a track Attached to the unit is an extended arm with a clamp, which holds the safety valve. Also attached to the unit is a positioning arm, which is placed against the drill pipe or tubing in order to vertically align the safety valve. The length of both arms can be adjusted as necessary, by using the locking bolts. When not in use, the arms are out of the way. When the system is activated, the extended arm is rotated into position to align the safety valve directly over the drill pipe or tubing. The three-stage double-acting hydraulic extension system can raise the extension arm high enough vertically (up to 12 feet) to allow the operator to stabilize the safety valve, then lower it, without exposing drilling personnel to the well's high pressures. The hydraulic unit can exert a downward force in excess of 3,000 psi through the extension arm, thereby preventing an oil well blowout the possibility of a fire, and environmental damage. After lowering the valve into the drill pipe or tubing, the hydraulic unit can hold the valve in position while a single crew member makes up the valve and closes the well in. Even these functions can be located and operated remotely, so that no drilling personnel need to be near the well during any part of the process. Because the present invention greatly reduces the length of time required to install a safety valve in unexpected high pressure situations, its use greatly improves safety for drilling personnel.

It is an object of the present invention to provide an apparatus to hold and stab a safety valve into a drill pipe or tubing when gases and liquids are flowing therefrom in an uncontrolled manner.

It is another object of the present invention to provide an apparatus which can be operated remotely, thereby keeping drill personnel away from hazardous conditions.

A further object of the present invention is to provide an apparatus which can operate properly and effectively, even in extreme high pressure situations.

It is still another object of the present invention to provide an apparatus which operates quickly and efficiently to bring a well under control.

Yet another object of the present invention is to shut down a burning oil well, extinguish the fire, and prevent damage to the environment.

DESCRIPTION OF A PREFERRED EMBODIMENT

Figure 1:
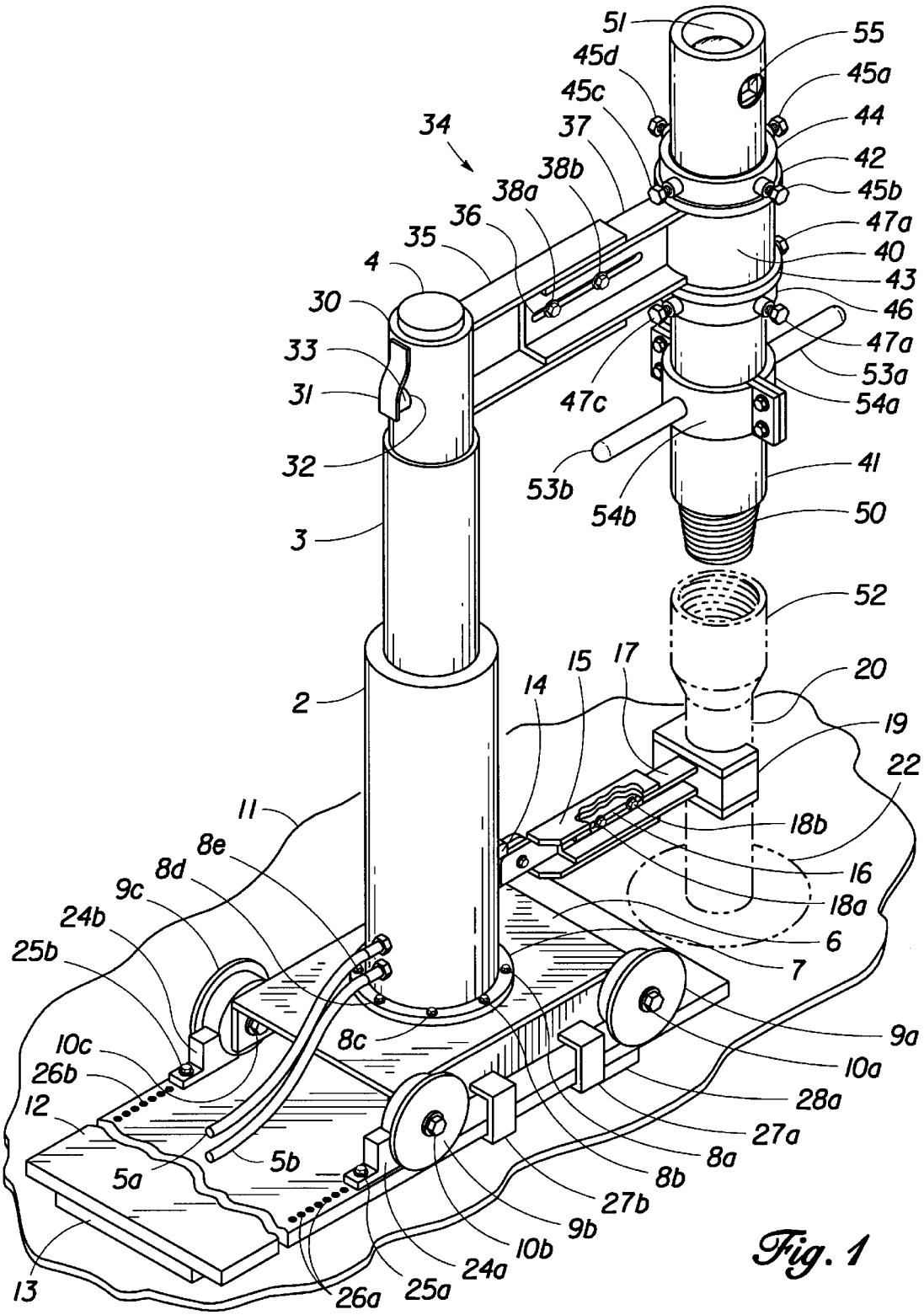
FIG. 1 is an isometric view of an embodiment of the flow control system of the present invention.

Referring to FIG. 1, the apparatus 1 of the present invention is shown in an operational position. The apparatus utilizes a three-stage double-acting, telescoping, hydraulic extension system, comprising a stainless steel hydraulic unit 2 with a first hydraulic cylinder extension 3 and a second hydraulic cylinder extension 4 telescoping upwardly, with power supplied by a remote hydraulic pump (not shown) through hydraulic hoses 5*a*, 5*b*. The hydraulic unit 2 is supported by a base 6, and is attached thereto by base plate 7 with bolts 8*a*, 8*b*, 8*c*, 8*d*, 8*e*. Steel wheels 9*a*, 9*b*, 9*c* (9*d* not shown) with outer flanges (i.e., railroad train wheels) are mounted onto the sides of the base 6 with holding bolts 10*a*, 10*b*, 10*c* (10*d* not shown). The apparatus 1 has been guided to a ready position by moving it along track assembly 11, generally formed by welding together two rectangular steel plates (each at least ¾" thick), with the upper track plate 12 having a wider dimension than the lower track plate 13. Mounted on the hydraulic unit 2 is a positioning bar slide 15 with a slot 16, generally a steel I-beam. A slot (not shown) in yoke slide 17, also a steel I-beam, has been aligned with the slot 16 in positioning bar slide 15, and bolts 18*a*, 18*b*, have been inserted in the slot 16 and fastened. Welded to the yoke slide 17 is formed yoke 19, which is positioned against the drill pipe or tubing 20, which is supported by rotary table 22. After the apparatus 1 is in position, further movement of the wheels 9*a*, 9*b*, 9*c*, 9*d* is prevented by using locking stops 24*a*, 24*b*, which are secured by inserting pins 25*a*, 25*b* into the positioning holes (e.g., 26*a*, 26*b*). Steel safety clamps 27*a*, 27*b*, (27*c* and 27*d*, on opposite side, not shown) prevent vertical movement of the apparatus 1, which might otherwise result as a result of high pressure upward forces from the well. A stop block 28*a* (28*b*, on opposite side, not shown) welded to the underside of upper track plate 12 keeps the hydraulic unit 2 from rolling towards the drill pipe 20.

Mounted on the second hydraulic cylinder extension 4 is a steel swivel bearing sleeve 30 with a steel spring 31 attached thereto. A spring-loaded stainless steel plug bolt 32 inserted in plug bolt hole 33 locks the swivel bearing sleeve 30 in place for operation.

Welded to the swivel bearing sleeve 30 is an extended arm slide 35 with a slot 36, generally a steel I-beam. A slot (not shown) in clamp slide 37, also a steel I-beam, has been aligned with the slot 36 in extended arm slide 35, and bolts 38*c*, 38*b* have been inserted in the slot 36 and fastened. Welded to the clamp slide 37 is steel holding clamp 40, which holds the safety valve 41 in a vertical position.

The holding clamp 40 has an upper bearing with flange 42 and a lower bearing with flange 43. The safety valve 41 is supported by an upper halo clamp 44 with four screwed hold-down pins 45*a*, 45*b*, 45*c*, 45*d* and a lower halo clamp 46 with four screwed hold-down pins 47*a*, 47*b*, (47*c* 47*d* not shown). The halo clamps 44, 46 are secured against the flange of the upper bearing 42 and the flange of the lower bearing 43. The safety valve 41 cannot move vertically within the safety valve 41, but it can be rotated with little effort.

In operation, the double-acting hydraulic unit 2 lowers the pin end 50 on the safety valve 41 into the well's flow, which is directed through the upper opening 51 of the safety valve 41. The downward pressure created by the three-stage hydraulic unit 2 is greater than the well's formation pressure, allowing remotely-located drill personnel to lower the pin end 50 on the safety valve 41 into the box end 52 of the drill pipe or tubing 20 and to hold the safety valve 41 in place. A crewmember then screws the pin end 50 on the safety valve 41 into the threads of the drill pipe or tubing 20, using the handles 53*a*, 53*b*, which are attached to C-clamps 54*a*, 54*b*, which have been bolted together onto safety valve 41. A ring (not shown) may be attached to the outer ends of the handles 53*a*, 53*b* to allow a crewperson to rotate the safety valve 41 more easily. The rotation of the safety valve 41 can also be performed remotely. After the safety valve 41 has been tightened with a pipe wrench or tongs (not shown), a crewmember closes the ball valve 55 located near the top of the safety valve 41, thereby closing off the flow of fluids and gases until proper well kill methods can be implemented. During no time is a crewmember exposed to the direct flow of fluids or gases from the well.

Figure 2:
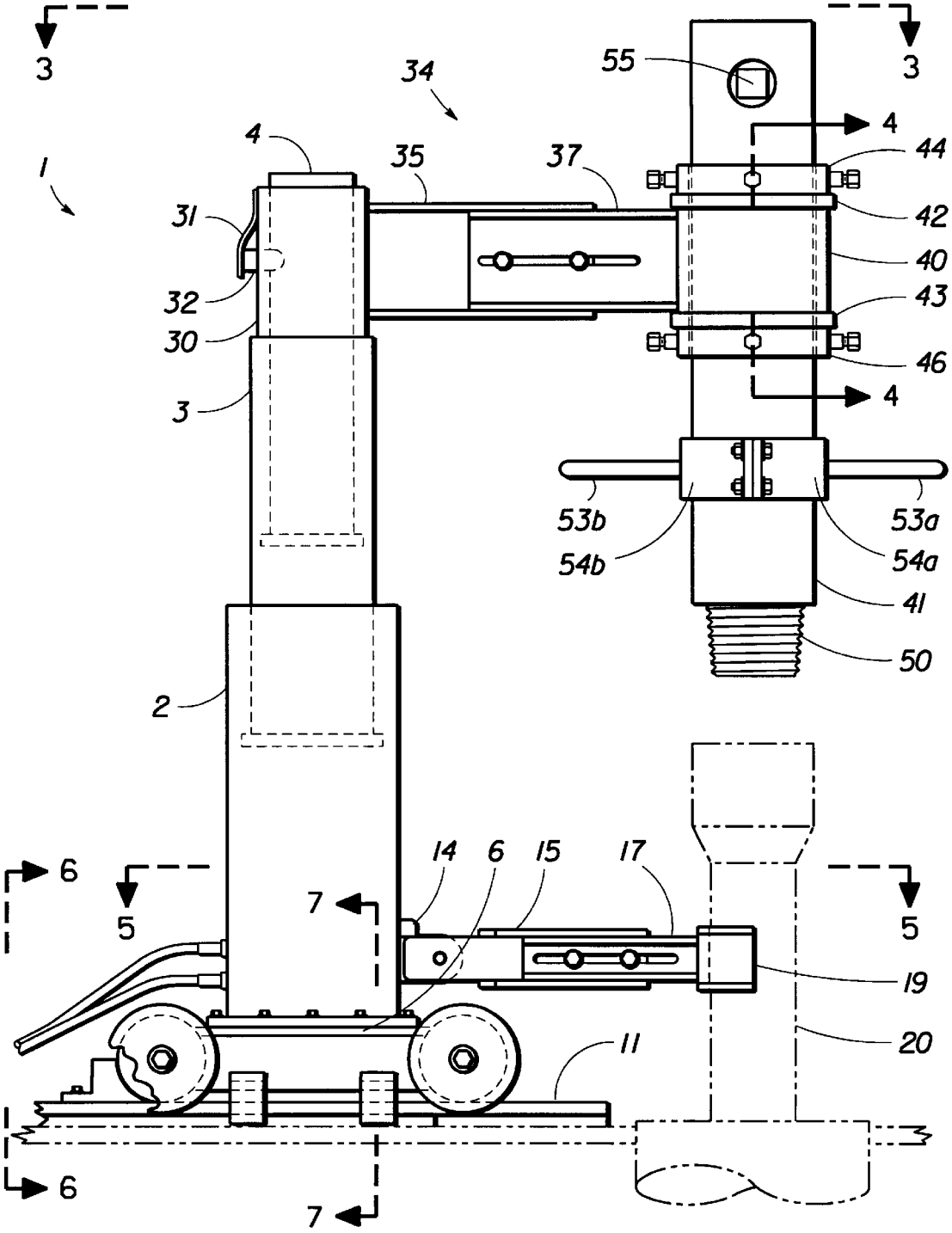
FIG. 2 is a side view of the present invention, showing the extended arm holding the safety valve above the open drill pipe or tubing, with the positioning arm against the drill pipe or tubing.

FIG. 2 is a side view of the apparatus 1, showing the hydraulic unit 2 on base 6. The apparatus 1 has been pulled into position on the track assembly 11, and the yoke 19 has been positioned against the drill pipe 20. The first hydraulic cylinder extension 3 and second hydraulic cylinder extension 4 have raised the extended arm assembly 34 into position above the drill pipe 20. The safety valve 41, positioned inside holding clamp 40, is prevented from moving vertically by upper halo clamp 44 and lower halo clamp 46. Handles 53*a* and 53*b* can be used to rotate the safety valve 41 and thereby screw its pin end 50 into the drill pipe 20.

Figure 3:
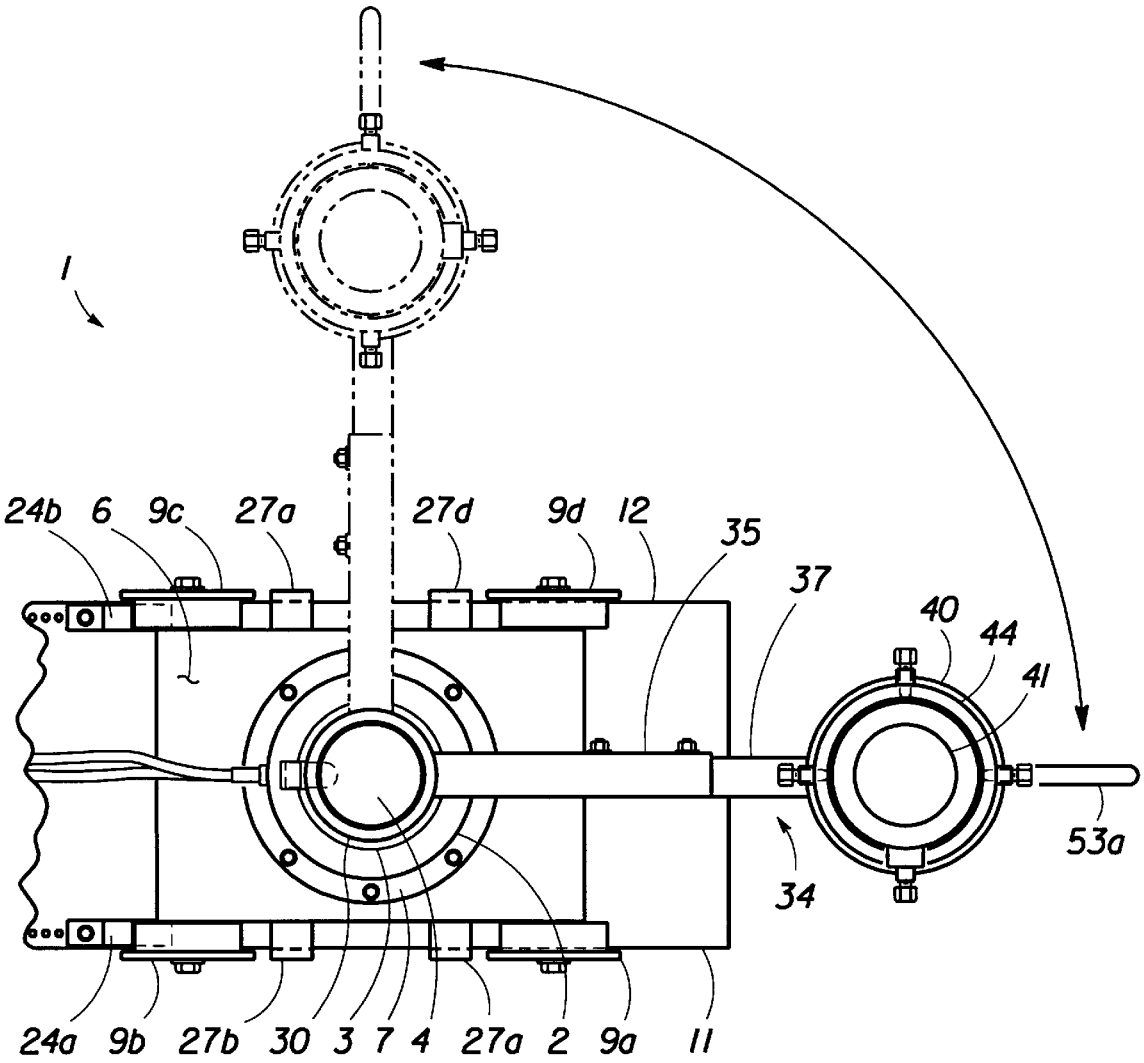
FIG. 3 is a top view of the present invention, showing the extended arm rotated between a ready position and an operational position.

The top view of FIG. 3 shows the extended arm assembly 34 in a ready position (shown with dotted lines) and in an operational position, after the arm has been rotated 90° horizontally and the plug bolt 32 has locked the swivel bearing sleeve 30 in place. The flanges of wheels 9*a*, 9*b*, 9*c*, 9*d* extend over the sides of the upper track plate 12. Locking stops 24*a*, 24*b*, 24*c*, 24*d* prevent the apparatus 1 from rolling away from the drill pipe 20. Safety clamps 27*a*, 27*b*, 27*c*, 27*d* prevent vertical movement of the apparatus 1.

Figure 4:
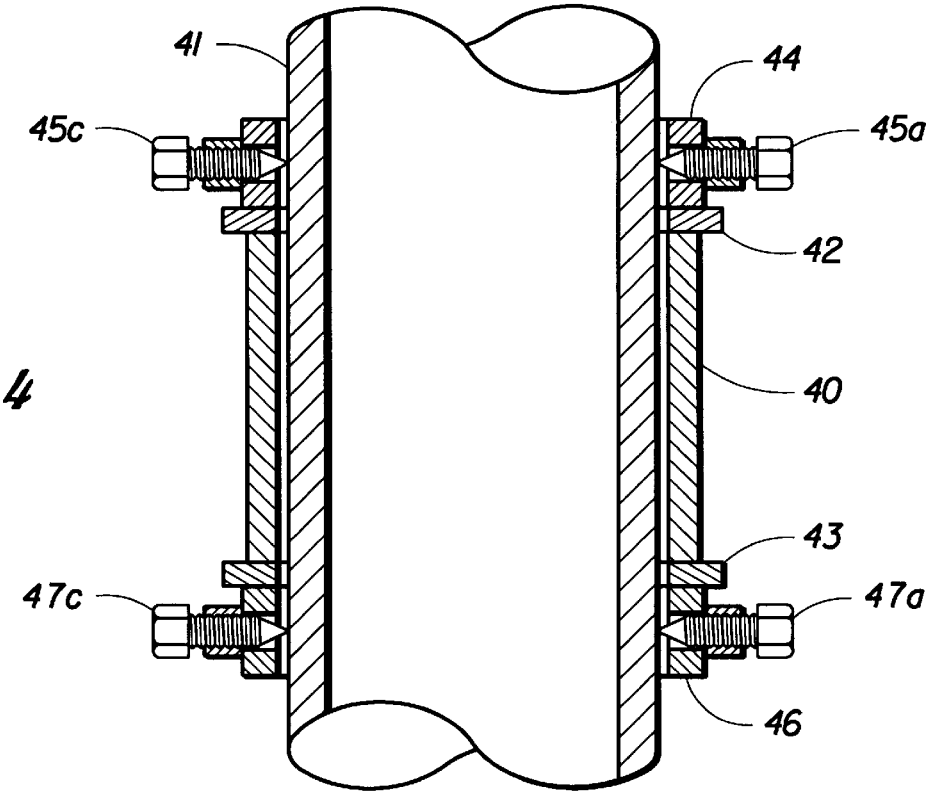
FIG. 4 is a cross-sectional detail drawing showing the holding clamp for the safety valve.

The method of the present invention requires the holding clamp 40 shown in FIG. 4 to prevent any vertical movement of the safety valve 41, while allowing it to turn as it is screwed into the drill pipe 20. The present invention utilizes both an upper halo clamp 44 with hold-down pins 45*a*, 45*c* (45*b*,45*d* not shown) and a lower halo clamp 46 with hold-down pins 47*a*, 47*c* (47*b*, 47*d* not shown) to hold the safety valve 41 in place and to prevent vertical movement of the safety valve 41. The upper halo clamp 44 rests on the surface of the upper bearing with flange 42, which acts as a race, allowing the upper halo clamp 44 to rotate with the safety valve 41 within the holding clamp 40. The lower halo clamp 46 likewise abuts the surface of the lower bearing with flange 43, which also acts as a race, allowing the lower halo clamp 46 to rotate. The size of each bearing with flange varies according to the size of the safety valve 41 which is being installed.

Figure 5:
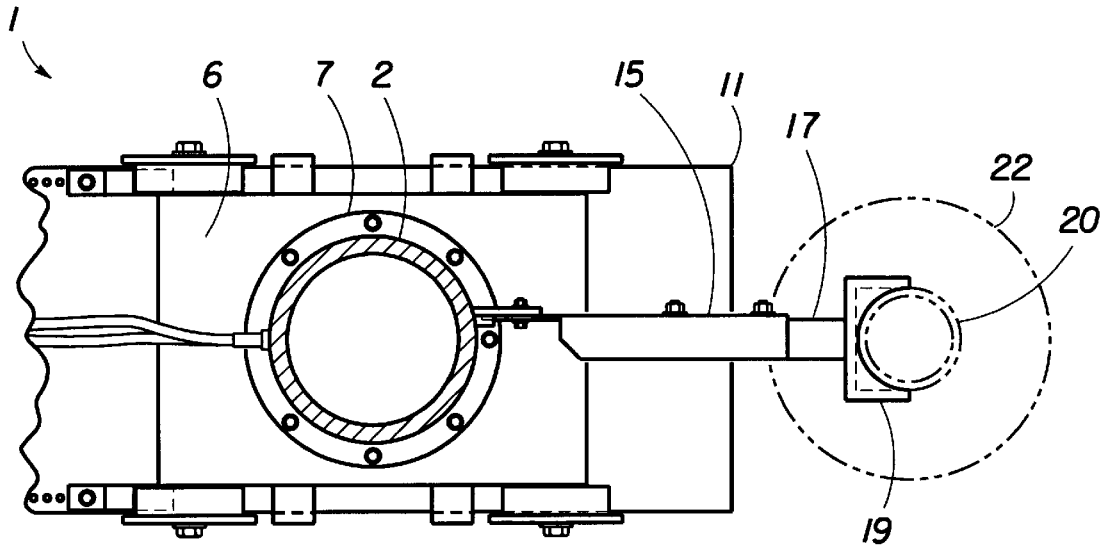
FIG. 5 is a top view of the track assembly and the positioning arm, which is used to hold the drill pipe in a vertical position.

The top view of FIG. 5 shows the yoke 19, held by yoke slide 17 and positioning bar slide 15, after it has been positioned against drill pipe 20, which is supported by rotary table 22. The positioning bar slide 15 is swivel-mounted to hydraulic unit 2, which is bolted onto the base 6 by base plate 7. The track assembly 11 is described supra.

Figure 6:
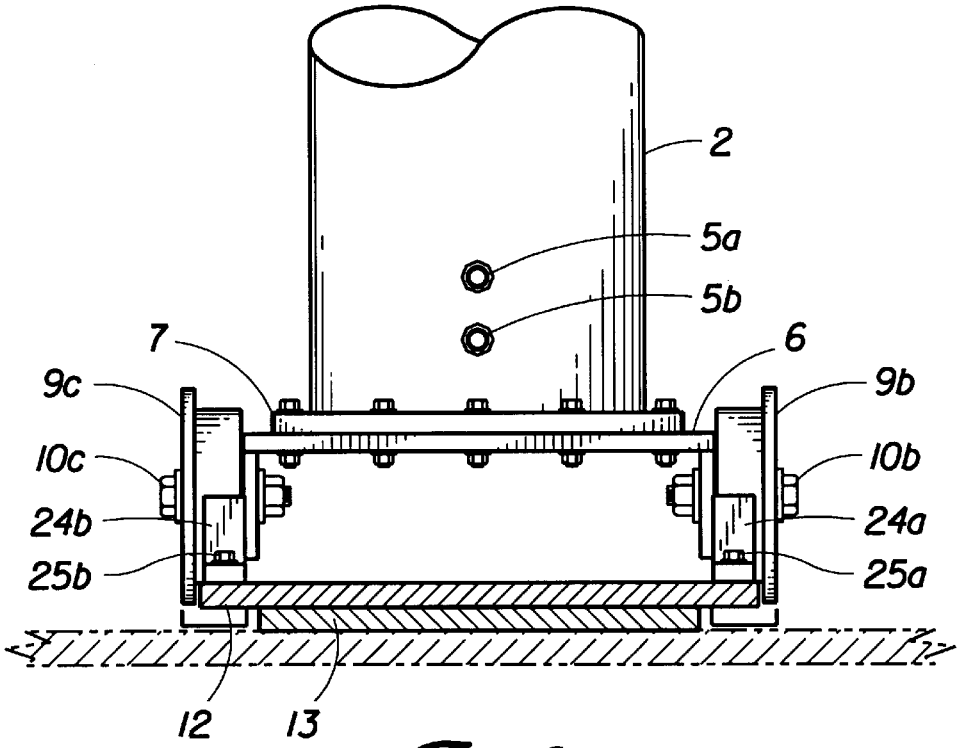
FIG. 6 is a rear view of the hydraulic unit, the base and the track assembly of the present invention.

In FIG. 6, the opening for hydraulic hoses 5*a*, 5*b* can be seen on hydraulic unit 2, which is bolted onto the base 6. The flanges of wheels 9*b*, 9*c* extend over the sides of upper track plate 12. Locking stops 24*a*, 24*b*, held in place by locking pins 25*a*, 25*b*, keep the hydraulic unit 2 from rolling away from the drill pipe 20.

Figure 7:
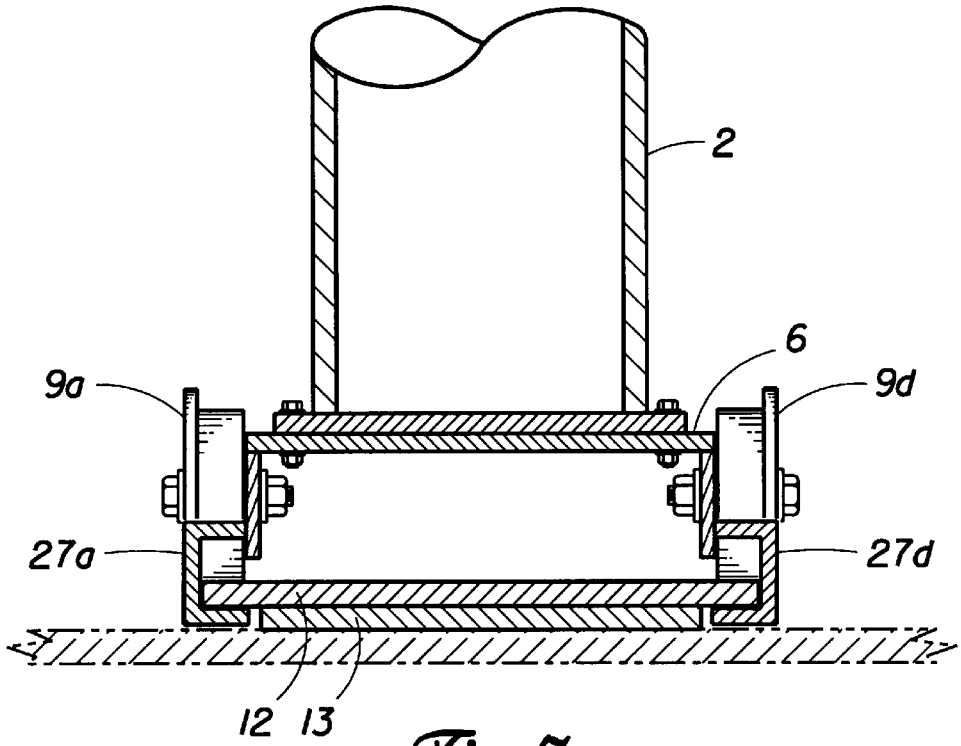
FIG. 7 is a cross-sectional view of the track assembly and the safety clamps of the present invention.

In FIG. 7, the functioning of the safety clamps 27*a*, 27*d* (27*b*, 27*c* not shown) can be more easily understood. The upper ends of the channel-shaped steel safety clamps 27*a*, 27*d* are welded to the sides of the base 6. The lower ends of the safety clamps 27*a*, 27*d*,are positioned under the lower side of upper track plate 12. The lower track plate 13 is not as wide as the upper track plate 12, thereby allowing the safety clamps 27*a*, 27*b*, 27*c*, 27*d* to slide along horizontally under the upper track plate 12. The safety clamps 27*a*, 27*b*, 27*c*, 27*d* prevent any vertical movement of the base 6 and the hydraulic unit 2 attached thereto by base plate 7.

Figure 8:
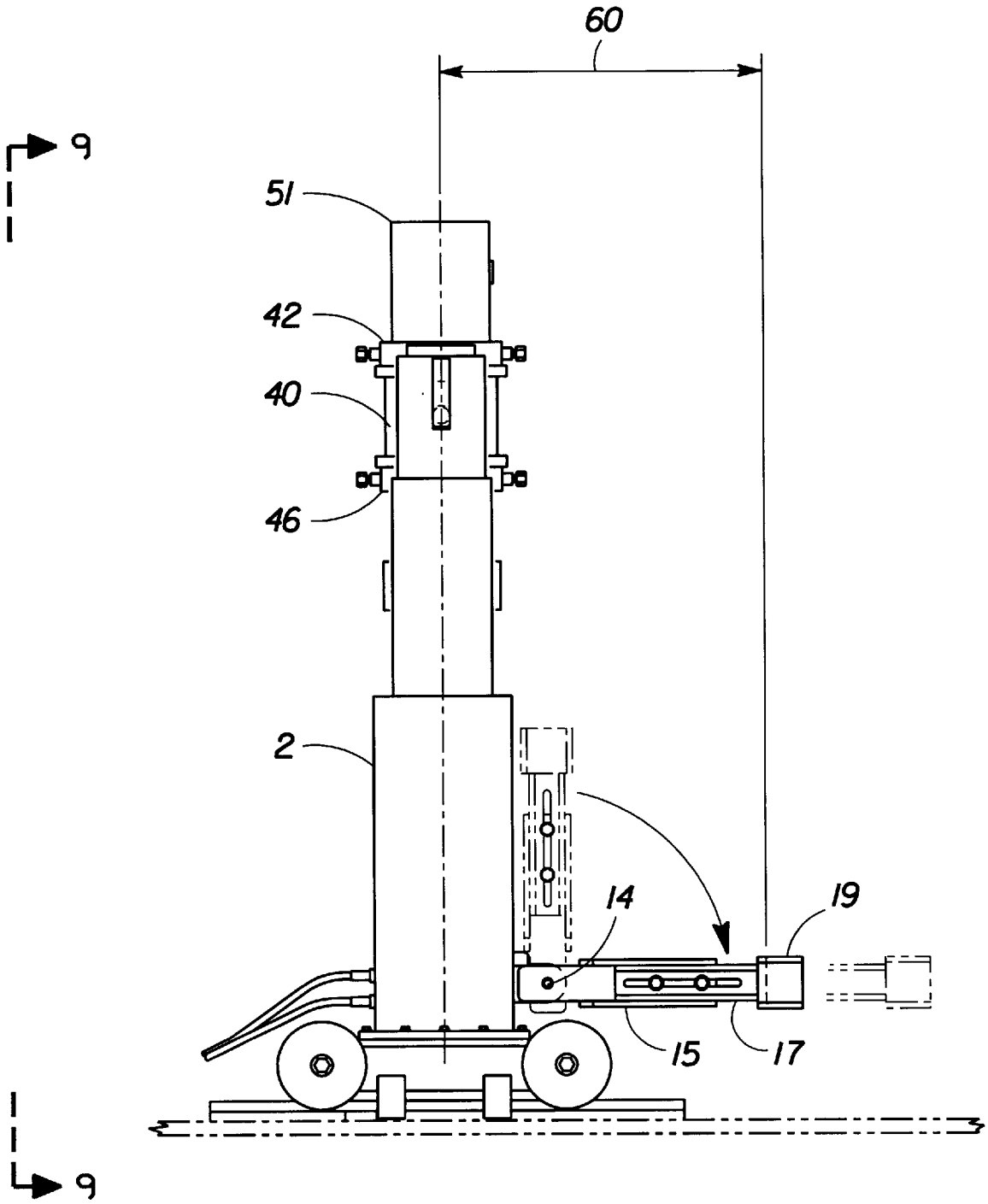
FIG. 8 is a side view of the present invention showing the positioning arm rotated between a stored position and an operational position for vertical positioning of the safety valve.

In FIG. 8, the holding clamp 40 is in the ready position behind the hydraulic unit 2; the upper opening 51 of the safety valve 41 can be seen, as well as parts of the upper halo clamp 44 and the lower halo clamp 46. The yoke 19 has been rotated downward 90°, using the swivel 14, from the stored position to the operational position. When the yoke 19 rests against the drill pipe or tubing 20 (not shown), the measurement of the distance at 60, from the centerline of the hydraulic unit 2 to the inner circumference of the yoke 19 provides information for adjustment of the position of the holding clamp 40. Further extension of the yoke 19 is accomplished by adjusting the positioning bar slide 15 and the yoke slide 17.

Figure 9:
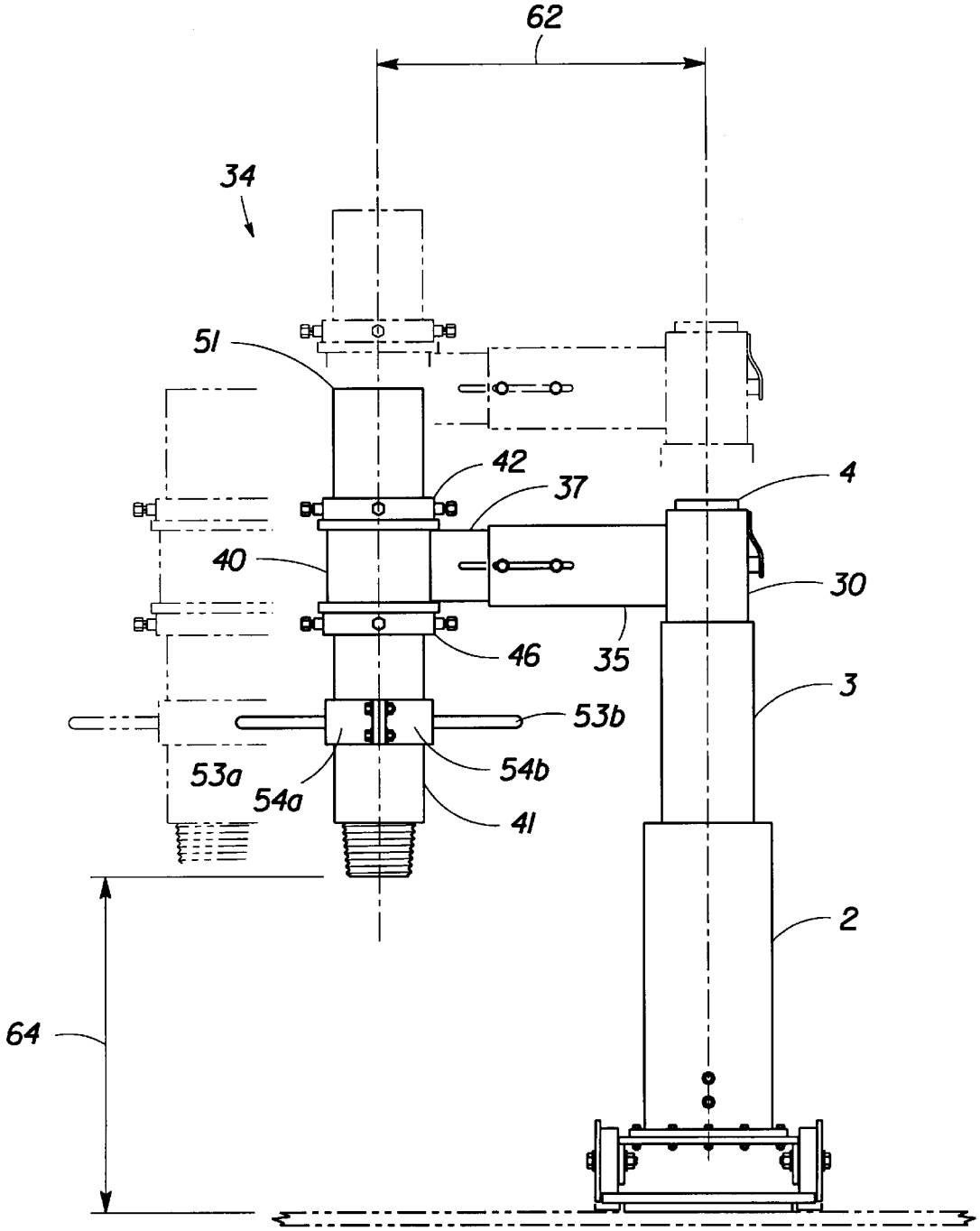
FIG. 9 is a back view of the present invention, showing how the extended arm can be raised and extended in order to position the safety valve over the drill pipe.

In FIG. 9, at 62, a measurement is made of the extended arm assembly 34 relative to the hydraulic unit 2. The measurement is made from the centerline of the safety valve 41 to the centerline of the hydraulic unit 2 and is correlated to the measurement 60, supra in FIG. 8. Adjustments to the position of the holding clamp 40 can be made, if necessary, by adjusting the extended arm slide 35 and the clamp slide 37. The object of the adjustments is to insure that the safety valve 41 can be properly aligned with and threaded into the drill pipe or tubing 20 (not shown). The measurement made at 64 determines whether the safety valve 41 needs to be raised or lowered (it must be high enough to clear the top of the drill pipe or tubing 20), using hydraulic unit 2, which raises and lowers holding clamp 40.

Figure 10A:
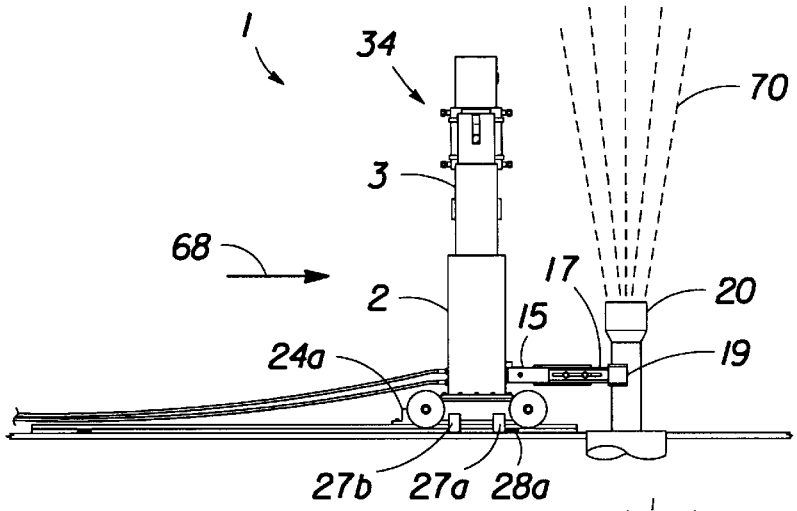
FIGS. 10A through 10C show the sequence of operations required to utilize the present invention in order to shut off upward flow from a drill pipe.

In FIG. 10A, extended arm assembly 34 is behind hydraulic unit 2 in a ready position. The apparatus 1 is moved in the direction of arrow 68, towards the drill pipe 20, until the yoke 19 rests against drill pipe 20, from which an upward flow 70 of gas and liquids is escaping. Locking stop 24*a* is in place, as are safety clamps 27*a* and 27*b*, and block 28*a*, all utilized to prevent unwanted movement of the apparatus 1.

Figure 10B:
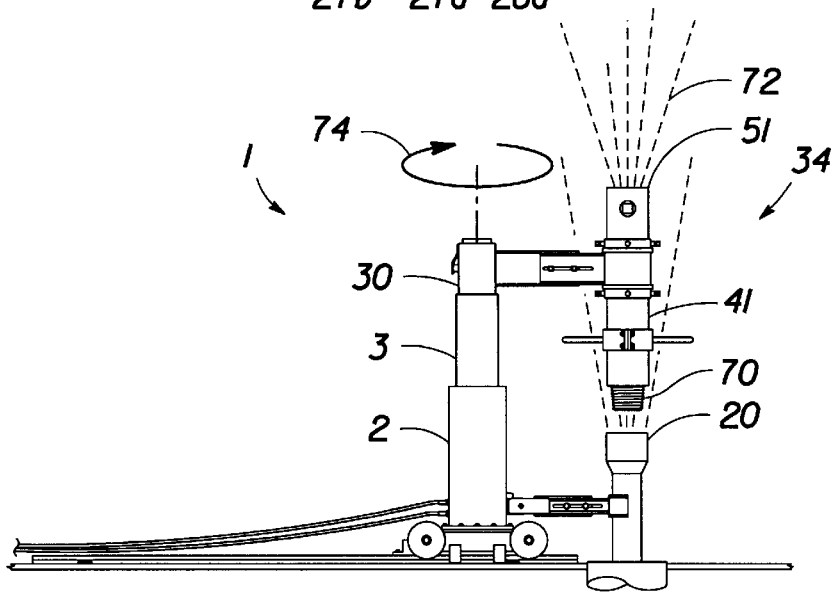

Fin FIG. 10B, the extended arm assembly 34 has been rotated (arrow 74) to position the safety valve 41 over the drill pipe 20. The upward flow 70 of gas and liquids has been diverted through the safety valve 41 out through the upper opening 51 of the valve.

Figure 10C:
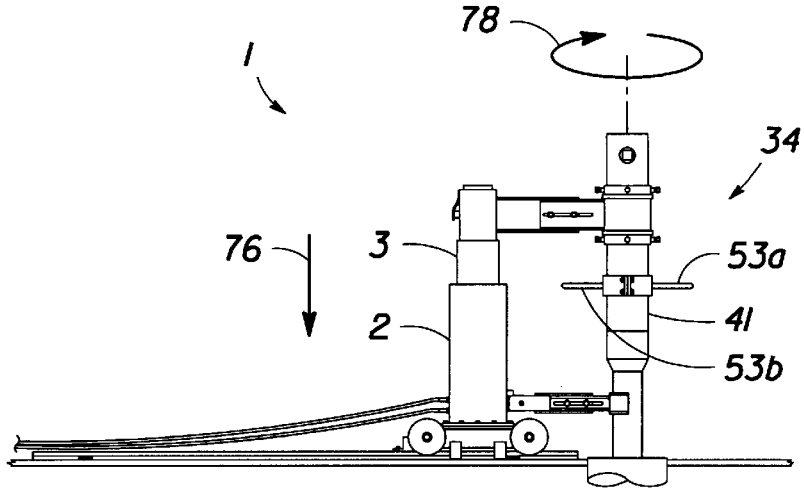

In FIG. 10C, the hydraulic unit 2 performs a downward movement at 76, while the safety valve 41 is rotated (at arrow 78) by turning the handles 53*a*, 53*b*, thereby completing the threading of the safety valve 41 into the drill pipe 20.

Figure 11:
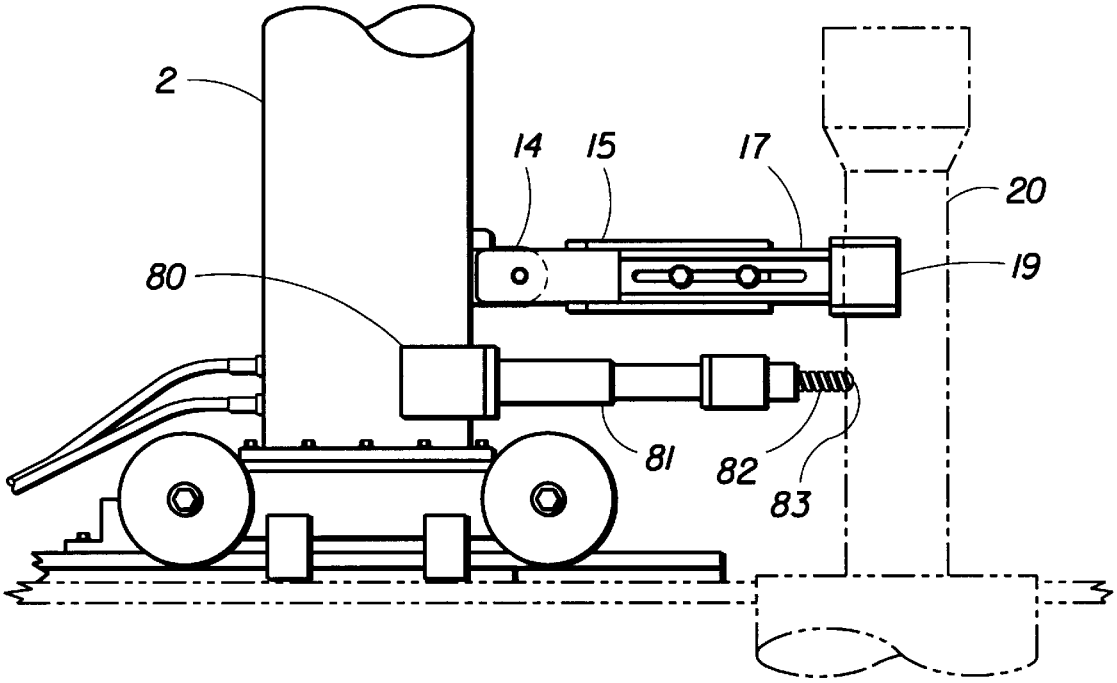
FIG. 11 is a side view of an optional hydraulic drill and tap which can be used to inject nitrogen into the drill pipe.

In FIG. 11, an optional hydraulic drill base 80 can be attached to the hydraulic unit 2. The hydraulic drill extension 81 advances a drill 82 against the drill pipe 20; the drill 82 opens a hole 83 through which nitrogen can be injected into the drill pipe 20, in order to prevent a well from catching on fire.

I claim:

1. Apparatus for shutting off upward flow from a conduit supported by a rotary table, said conduit having a threaded joint at its upper end, comprising:

a support unit with one or more cylinders extendable and retractable therefrom, said unit having an upper end and a base end;

a swivel mounted on the upper end of the support unit;

a clamping assembly attached to the swivel unit;

a safety valve having an open position and a closed position, the safety valve having a threaded lower end for engagement with the threaded joint, the safety valve being vertically disposed within the clamping assembly, said assembly preventing vertical movement of the safety valve within the clamping assembly, while allowing the safety valve to rotate about its longitudinal axis;

a carriage assembly attached to the base of the support unit, said carriage assembly resting on a track which directs linear, horizontal movement of the apparatus toward and away from the conduit;

a bar attached to the support unit, said bar having a yoke for resting against the conduit so that, based on previously-made measurements, the longitudinal axis of the safety valve will then be aligned with the longitudinal axis of the conduit for threading the end of the safety valve into the threaded joint;

drive means for vertical movement of the clamping assembly.

2. The apparatus of claim 1 which further includes a drill mounted on the support unit, said drill being used to inject nitrogen into the conduit.

3. The apparatus of claim 1 wherein the drive means is a hydraulic system.

4. The apparatus of claim 1 which further includes hydraulic drive means for rotational movement of the safety valve within the clamping assembly.

5. The apparatus of claim 1 which further includes means for preventing vertical movement of the support unit.

6. A method for shutting off upward flow from a conduit supported by a rotary table, said conduit having a threaded joint at its upper end, comprising:

placing a safety valve into a holding clamp attached to a hydraulically-driven support unit located on a rig floor, said safety valve having an open position and a closed position, and further having a threaded lower end for engagement with the threaded joint;

moving the support unit a premeasured distance from the conduit, said distance insuring longitudinal alignment of the safety valve and the conduit;

locking the support unit into place;

raising the holding clamp to a position high enough to clear the conduit;

rotating the holding clamp until a longitudinal axis of the safety valve is aligned with a longitudinal axis of the conduit;

lowering the holding clamp until the safety valve abuts the conduit;

screwing the threaded end of the safety valve into the threaded joint; and closing the safety valve.

7. The method of claim 6 in which the premeasured distance is established by using a positioning arm with a first end attached to the support unit and a second end abutting the conduit.

8. The method of claim 7, which further includes drilling a hole into the conduit and injecting nitrogen gas into the conduit.

* * * * *